United States Patent [19]

Takeda et al.

[11] Patent Number: 4,925,110

[45] Date of Patent: May 15, 1990

[54] FUEL INJECTION VALVE FOR AN INTERNAL COMBUSTION ENGINE HAVING A PILLAR OPPOSING A FUEL INJECTION HOLE

[75] Inventors: Keiso Takeda, Mishima; Kiyoshi Nakanishi, Susono; Taiyo Kawai, Susono; Rio Shimizu, Susono, all of Japan

[73] Assignee: Toyota Jidosha Kabushiki Kaisha, Japan

[21] Appl. No.: 287,346

[22] Filed: Dec. 21, 1988

[30] Foreign Application Priority Data

| | | | |
|---|---|---|---|
| Dec. 28, 1987 | [JP] | Japan | 62-197544 |
| Dec. 29, 1987 | [JP] | Japan | 62-200328 |
| Dec. 29, 1987 | [JP] | Japan | 62-200330 |
| Dec. 29, 1987 | [JP] | Japan | 62-200332 |
| Dec. 29, 1987 | [JP] | Japan | 62-200327 |
| Dec. 29, 1987 | [JP] | Japan | 62-200329 |
| Dec. 29, 1987 | [JP] | Japan | 62-200331 |

[51] Int. Cl.[5] ..... F02M 69/00; F02M 51/06

[52] U.S. Cl. ..... 239/533.12

[58] Field of Search ..... 239/533.2, 533.3, 533.6, 239/533.9, 533.12, 584, 585; 251/129.15

[56] References Cited

U.S. PATENT DOCUMENTS

| | | | |
|---|---|---|---|
| 4,657,189 | 4/1987 | Iwata et al. | 239/533.12 |
| 4,771,948 | 9/1988 | Furukawa et al. | 239/533.12 |
| 4,773,374 | 9/1988 | Kiuchi et al. | 239/533.12 |

FOREIGN PATENT DOCUMENTS

| | | |
|---|---|---|
| 60204962 | 10/1960 | Japan . |
| 61-160266 | 10/1986 | Japan . |
| 61-198574 | 12/1986 | Japan . |

*Primary Examiner*—Andres Kashnikow
*Assistant Examiner*—Karen B. Merritt
*Attorney, Agent, or Firm*—Oliff & Berridge

[57] ABSTRACT

A fuel injection valve for an internal combustion engine includes an injector body and an adapter. The injector body includes a single fuel injection hole and the adapter includes a concave portion defining a dead volume portion and a pillar extending from a bottom surface of the concave portion toward the fuel injection hole formed in the injector body. Fuel injected through the fuel injection hole into the dead volume portion collides with a top surface of the pillar to form a cone-like fuel flow pattern and a large portion of the fuel can directly flow into injected fuel paths formed in the adapted without attaching to and collecting on surfaces of various portions of the adapter. Thus, stable fuel injection from the injected fuel paths can be obtained.

14 Claims, 6 Drawing Sheets

FUEL INJECTION VALVE FOR AN INTERNAL COMBUSTION ENGINE HAVING A PILLAR OPPOSING A FUEL INJECTION HOLE

BACKGROUND OF THE INVENTION

1. Field of the Invention

The present invention relates to an electro-magnetic type fuel injection valve for an internal combustion engine and, more particularly, relates to a fuel injection valve which includes an injector body having a single fuel injection hole and an adapter having a plurality of injected fuel paths for injecting the fuel injected through the fuel injection hole into an intake path of the engine.

2. Description of the Related Art

Japanese Patent Publication SHO No. 60-204962 and Japanese Utility Model Publication SHO No. 61-160266 disclose a fuel injection valve having three injected fuel paths. The prior art fuel injection valve includes an injector body and an adapter fixed to the injector body. The injector body includes a single fuel injection hole for metering fuel to be injected and the adapter includes a concave portion for defining a dead volume portion into which the fuel injected through the fuel injection hole is injected and three injected fuel paths which extend through the adapter and open to the dead volume portion. The concave portion has a flat bottom surface perpendicular to an axis of the adapter, and the three injected fuel paths open to the dead volume portion at the bottom surface of the concave portion. The fuel injected through the fuel injection hole into the dead volume portion forms a pillar-like pattern of injected fuel at the dead volume portion and flows toward the bottom surface of the concave portion. When the fuel collides with the bottom surface of the concave portion, the fuel changes its flow direction from a direction along the axis of the adapter to a direction along the bottom surface of the concave portion which is substantially perpendicular to the axis of the adapter. As a result, a large portion of the fuel attaches to either the bottom surface and the side surface of the concave portion or the inside surfaces of the injected fuel paths and momentarily collects on the surfaces. When the collecting fuel increases in amount and the weight of the collecting fuel finally exceeds the surface tension of the collecting fuel, the collecting fuel begins to move downward along the surfaces and is injected from the injected fuel paths into the intake port of the engine together with a fuel which is injected at successive injection timings. When the fuel is collecting on the surfaces of the concave portion and the injected fuel paths, the air-fuel ratio of the engine becomes greater than the specified value and the fuel-mixed gas of the engine becomes lean, while when the collecting fuel is released from the surfaces and flows into the intake port of the engine, the fuel-mixed gas of the engine becomes rich. Thus, the collecting fuel makes the response characteristic of the engine unstable. Further, because the collecting fuel flows into the intake port of the engine in the form of lumps which are not sufficiently atomized or broken into pieces, the fuel in the form of lumps deteriorates combustion characteristics of the engine. Thus, it is desired to minimize the attachment of the fuel onto the surfaces of the concave portion and the injected fuel paths.

SUMMARY OF THE INVENTION

An object of the invention is to suppress attachment of the fuel to the surfaces of the concave portion and the injected fuel paths.

The above-described object of the invention is performed by a fuel injection valve adapted for mounting on an internal combustion engine in accordance with the present invention.

The fuel injection valve of the present invention includes:

an injector body having an end surface and a single fuel injection hole for metering fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion having an axis common with the axis of the adapter, a side surface and a bottom surface, the side and bottom surfaces of the concave portion of the adapter and the end surface of the injector body defining therebetween a dead volume portion located in a direction downstream of the fuel injection hole formed in the injector body;

a plurality of injected fuel paths formed in the adapter and located downstream of the dead volume portion, each injected fuel path penetrating the adapter in an axial direction of the adapter and being inclined radially outward in the downstream direction with respect to the axis of the adapter so as to be further distanced from the axis of the adapter in a direction perpendicular to the axis of the adapter at a downstream portion thereof than at an upstream portion thereof, the upstream ends of all the injected fuel paths being arranged so as to be equally spaced from each other in a circumferential direction of the adapter around the axis of the adapter; and a pillar having a longitudinal axis common with the axis of the adapter and extending into the dead volume portion from the bottom surface of the concave portion toward the fuel injection hole formed in the injector body, the pillar having a side surface and a top surface spaced from and opposite to the fuel injection hole formed in the injector body.

In the fuel injection valve in accordance with the present invention, the fuel which has been injected intermittently and successively through the fuel injection hole into the dead volume portion flows toward the top surface of the pillar in a pillar-like pattern of injected fuel. The fuel of a radially inner portion of the pillar-like pattern of injected fuel collides with the top surface of the pillar of the adapter opposing the fuel injection hole, while the fuel of a radially outer portion of the pillar-like pattern of injected fuel does not collide with the top surface of the pillar, because the diameter of the pillar-like pattern of injected fuel is larger than the diameter of the top surface of the pillar of the adapter. When the fuel of the radially inner portion of the pillar-like pattern of injected fuel collides with the top surface of the pillar, the fuel changes its flow direction from the direction along the axis of the adapter to the direction substantially perpendicular to the axis of the adapter and tends to flow radially outwardly. The radially outwardly flowing fuel joins the fuel of the radially outer portion of the pillar-like pattern of injected fuel which is generally flowing along the axis of the adapter. Both the fuel which tends to flow radially outwardly and the fuel which tends to flow along the axis of the adapter are joined or synthesized to produce a flow which, as a resultant vector, flows obliquely with respect to the axis of the adapter, more particularly, flows downwardly and radially outwardly forming a hollow cone-like pattern of fuel. As a result, a large portion of the joined fuel can directly flow into and pass through the injected fuel paths without attaching to and collecting on the side surface and the bottom surface of the concave portion and the inside surfaces of the injected fuel paths. Thus, the amount of the fuel injected from the injected fuel paths is stable without being affected by a fuel which has been injected through the fuel injection hole at prior injections and has collected on the surfaces of various portions of the adapter.

BRIEF DESCRIPTION OF THE DRAWINGS

The above and other objects, features and advantages of the present invention will become apparent and more readily appreciated from the following detailed description of the preferred exemplary embodiments of the invention taken in conjunction with the accompanying drawings, in which.

DETAILED DESCRIPTION OF THE PREFERRED EMBODIMENTS

Figure 10:
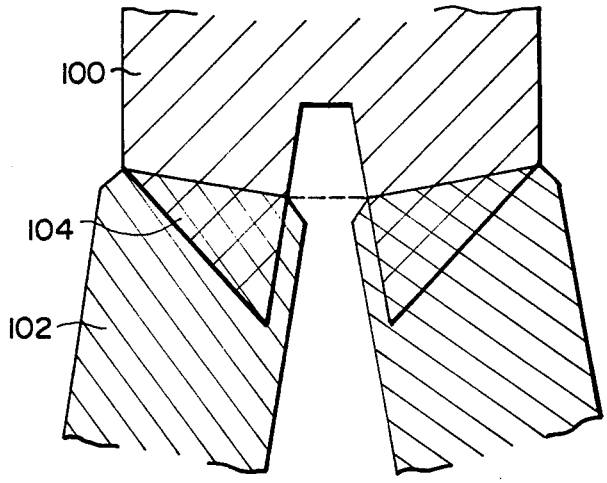
FIG. 10 is a cross sectional view illustrating relationship between a dead volume portion and an injected fuel path of the fuel injection valve of FIG. 9.
Figure 9:
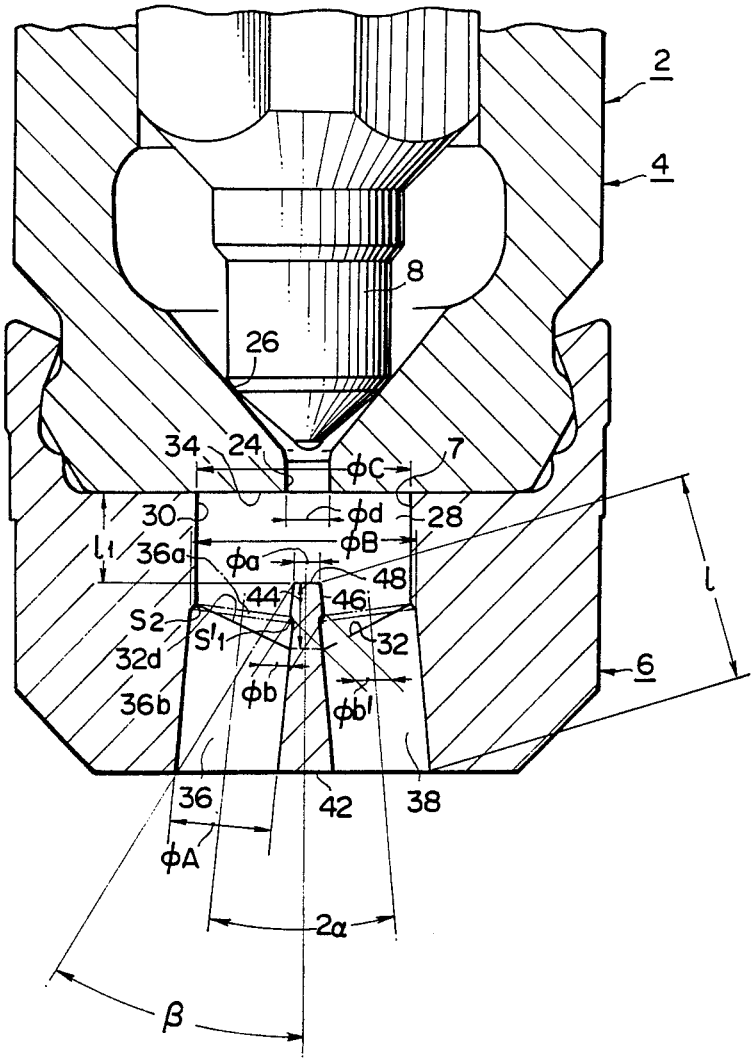
FIG. 9 is a cross sectional view of an end portion including an adapter of a fuel injection valve in accordance with a second embodiment of the present invention, FIG. 9 corresponding to a cross section taken along the same line as line I—I of FIG. 3 of the first embodiment.

Two embodiments will be explained. Because a first embodiment which is illustrated in FIGS. 1 to 8, and a second embodiment which is illustrated in FIGS. 9 and 10 have common structures with each other except a bottom surface of a concave portion and structures in the vicinity of the bottom surface, portions common in structure with respect to both embodiments are denoted with the same reference numerals.

Figure 4:
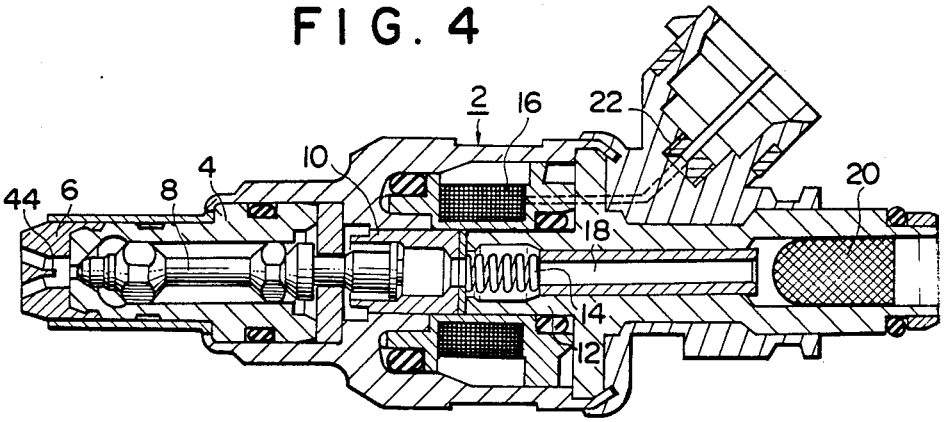
FIG. 4 is an entire, cross sectional view of the fuel injection valve of FIG. 1.

FIG. 4 illustrates an entire structure of a fuel injection valve adapted for mounting on an internal combustion engine, which is applicable to both embodiments of the present invention. The fuel injection valve 2 includes an injector body 4 having a longitudinal axis and an adapter 6 fixed to injector body 4. Adapter 6 has an axis common with the longitudinal axis of injector body 4. Fuel injection valve 2 includes a needle valve 8 movable in the axial direction of injector body 4; a movable core 10 contacting or coupling with needle valve 8 so as to be able to push needle valve 8 in the axial direction of injector body 4; a fixed core 12, provided so as to oppose movable core 10, for magnetically attracting movable core 10 in the axial direction of the injector body 10; a spring 14, provided so as to contact one end of movable core 10, for biasing movable core 10 in the direction away from fixed core 12; a coil 16 for generating a magnetic flux path through fixed core 12, movable core 10 and injector body 4 to attract movable core 10 to fixed core 12 when electric current flows in coil 16; a fuel path 18 for flowing fuel therethrough; and a strainer 20, provided upstream of fuel path 18, for filtering foreign particles which may be included in fuel. Electric current is supplied to coil 16 through a terminal 22. Fuel, which is controlled in pressure to have a constant pressure increment with respect to a changeable intake manifold pressure, is supplied to fuel injection valve 2. Electric current is intermittently supplied to coil 16 so that movable core 10 is intermittently attracted to fixed core 12 against the biasing force of spring 14 to thereby cause needle valve 8 to intermittently disengage the valve seat and to cause the fuel to be intermittently injected. The amount of fuel to be injected is controlled by changing a period of ON time of the intermittent supply of electric current to coil 16 in accordance with an output signal from an engine control computer (not shown).

The structure of an end portion of fuel injection valve 2 according to the first embodiment will be explained.

Figure 1A:
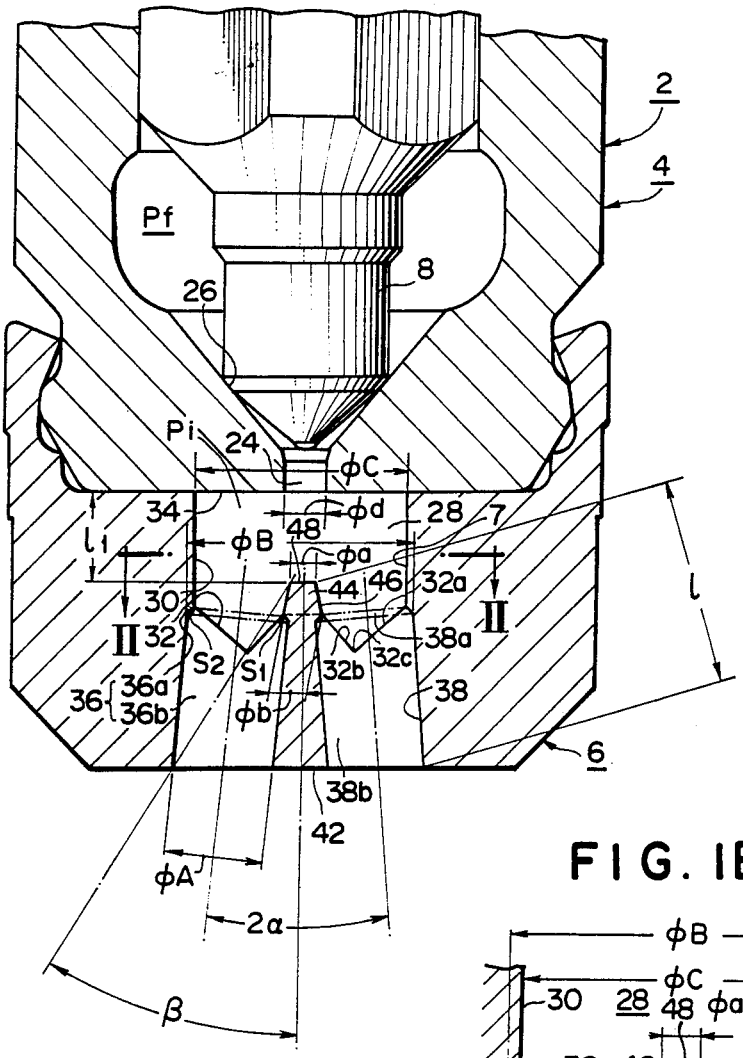
FIG. 1A is a cross sectional view of an end portion including an adapter and pillar of a fuel injection valve for an internal combustion engine in accordance with a first embodiment of the present invention.

FIG. 1A illustrates injector body 4 and adapter 6 fixed to the end portion of injector body 4. Injector body 4 has a longitudinal axis, an end surface 34 and a single fuel injection hole 24 for metering fuel to be injected. Fuel injection hole 24 has an axis common with the longitudinal axis of injector body 4 and opens at end surface 34 of injector body 4.

Adapter 6 has an axis common with the longitudinal axis of injector body 4. Adapter 6 includes a downwardly recessed concave portion 7 formed in adapter 6, a plurality of injected fuel paths formed in adapter 6, for example, three injected fuel paths 36, 38 and 40 (see FIG. 2), and a pillar 44.

More particularly, concave portion 7 has an axis common with the axis of adapter 6, a side surface 30 and a bottom surface 32. Side surface 30 and bottom surface 32 of concave portion 7 formed in adapter 6 and end surface 34 of injector body 4 define therebetween a dead volume portion 28 which is located downstream of fuel injection hole 24 formed in injector body 4. Concave portion 7 and pillar 44 can be machined by rotating a bite, which has a contour corresponding to the cross-sectional contour of both concave portion 7 and pillar 44, around the axis of adapter 6 as shown by a hatched portion 100 in FIG. 8.

Figure 1B:
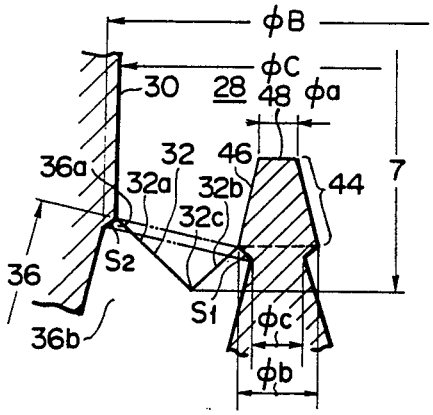
FIG. 1B is an enlarged view of the adapter and pillar of FIG. 1A.
Figure 2:
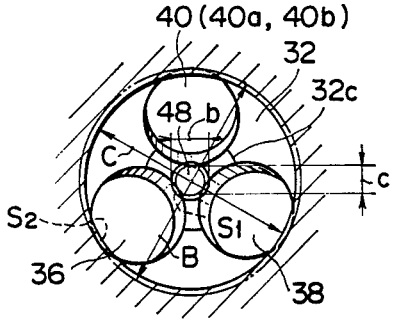
FIG. 2 is a partial, cross sectional view of the adapter of the fuel injection valve taken along line II—II of FIG. 1.
Figure 3:
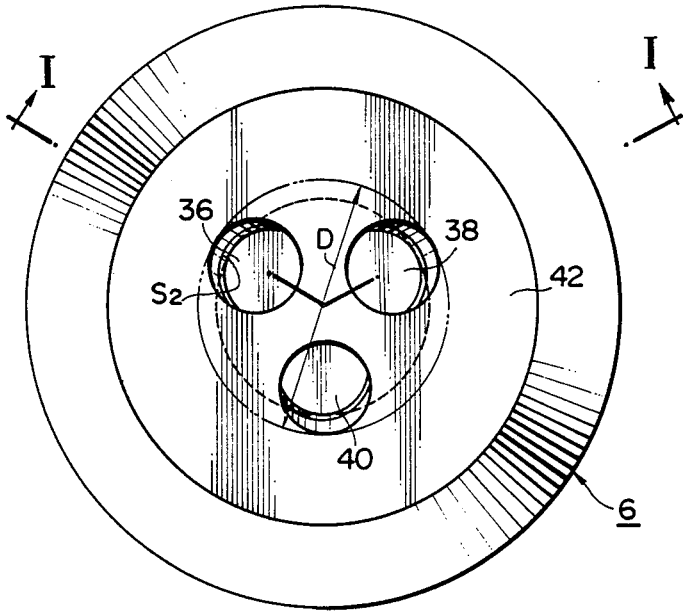
FIG. 3 is a bottom plan view of the adapter of the fuel injection valve of FIG. 1, FIG. 1 corresponding to a section taken along line I—I of FIG. 3.

As shown in FIGS. 2 and 3, injected fuel paths 36, 38 and 40 are arranged so as to be equally spaced from each other in a circumferential direction of adapter 6 around the axis of adapter 6. As shown in FIG. 1, injected fuel paths 36, 38 and 40 extend through adapter 6 in the axial direction of adapter 6 to communicate with dead volume portion 28 from a downstream side of dead volume portion 28 and to open to an intake port of an engine (not shown) at a lower surface 42 of adapter 6. Injected fuel paths 36, 38 and 40 flare radially outwardly or incline with respect to the axis of adapter 6 so as to be further spaced from the axis of adapter 6 in a direction perpendicular to the axis of adapter 6 at downstream portions of the injected fuel paths than at upstream portions of the injected fuel paths.

Each injected fuel path 36, 38, 40 includes an upstream tapering end portion 36*a*, 38*a*, 40*a* which is reduced in diameter in an upstream direction and a remaining straight portion 36*b*, 38*b*, 40*b* which has a constant cross sectional area over the entire length of the remaining portion. Each injected fuel path 36, 38, 40 can be machined by rotating a bite, which has a contour corresponding to a cross sectional contour of each injected fuel injected path 36, 38, 40, around the axis of each injected path 36, 38, 40 as shown by a hatched portion 102 in FIG. 8. Each injected fuel path 36, 38, 40 partially interferes in space with dead volume portion 28 as shown, in FIG. 8, by a cross-hatched portion 104 which is defined as an interference portion between hatched portions 100 and 102.

As shown in FIGS. 1A and 1B, pillar 44 extends from bottom surface 32 of concave portion 7 toward fuel injection hole 24 formed in injector body 4 and extends into dead volume portion 28. Pillar 44 has a longitudinal axis common with the axis of adapter 6, a side surface 46 and a top surface 48. Top surface 48 of pillar 44 is spaced from and faces fuel injection hole 24 formed in injector body 4.

Figure 5:
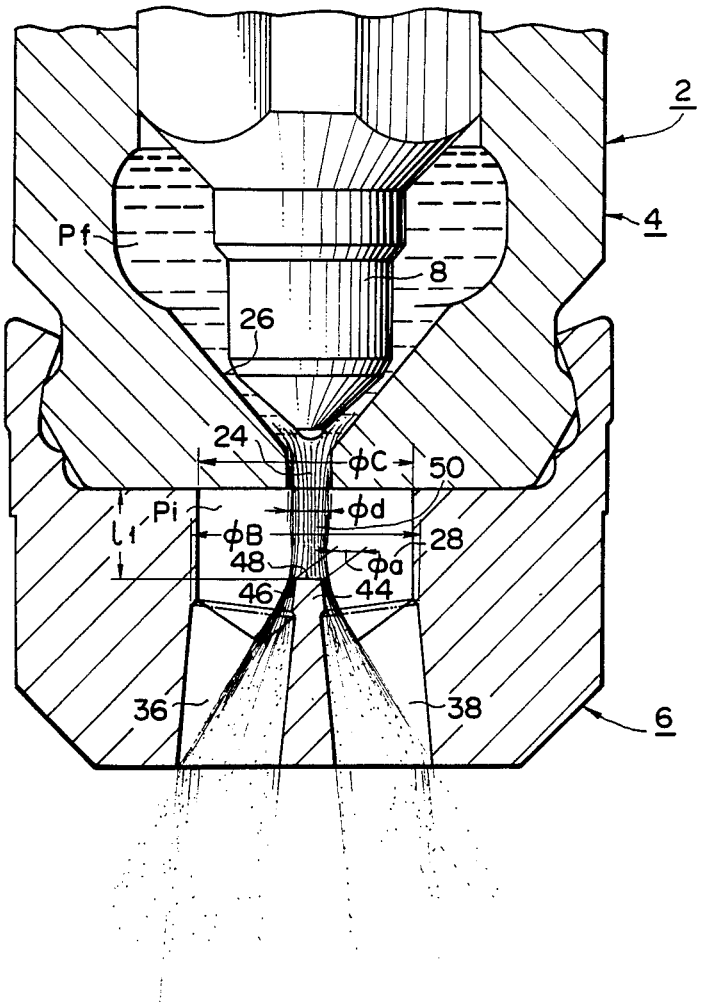
FIG. 5 is a cross sectional view of the end portion of the fuel injection valve of FIG. 1 also illustrating a fuel flow.
Figure 8:
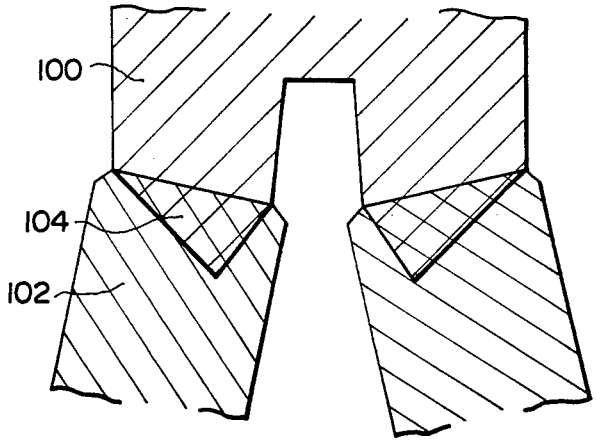
FIG. 8 is a cross sectional view illustrating structural interference relationship between a dead volume portion and an injected fuel path of the fuel injection valve of FIG. 1.

An area, measured in a direction perpendicular to the longitudinal axis of pillar 44, of top surface 48 of pillar 44 is smaller than a cross-sectional area, measured in a direction perpendicular to the axis of fuel injection hole 24 formed in injector body 4, of a pillar-like pattern of injected fuel 50 (shown in FIG. 5) which is formed, at dead volume portion 28, by the fuel injected from fuel injection hole 24. FIG. 5 illustrates a condition where needle valve 8 disengages valve seat 26 and fuel is being injected through fuel injection hole 24 into dead volume portion 28 to form the pillar-like pattern of injected fuel 50. Though pillar-like pattern of injected fuel 50 will be slightly reduced in diameter in the direction toward top surface 48 of pillar 44, the cross-sectional area of top surface 48 of pillar 44 is smaller than the reduced cross-sectional area of pillar-like pattern of injected fuel 50. It can be said that an area, measured in the direction perpendicular to the longitudinal axis of pillar 44, of top surface 48 of pillar 44 is smaller than a cross-sectional area of fuel injection hole 4 measured in a direction perpendicular to the axis of fuel injection hole 24.

As shown in FIG. 2, top surface 48 of pillar 44 is substantially circular in the direction perpendicular to the longitudinal axis of pillar 44. As shown in FIGS. 1A and 1B, top surface 48 of pillar 44 is substantially flat. However, top surface 48 of pillar 44 may be slightly curved to be upwardly convex. Pillar 44 has a circular cross-section in the direction perpendicular to the longitudinal axis of pillar 44 over the entire length of pillar 44. Side surface 46 of pillar 44 is tapered such that an upper portion of pillar 44 is smaller in diameter than a lower portion of pillar 44. More particularly, as shown in FIGS. 1A and 1B, a diameter a of an uppermost portion of pillar 44 is smaller than a diameter b of a lowermost portion of pillar 44.

Figure 7:
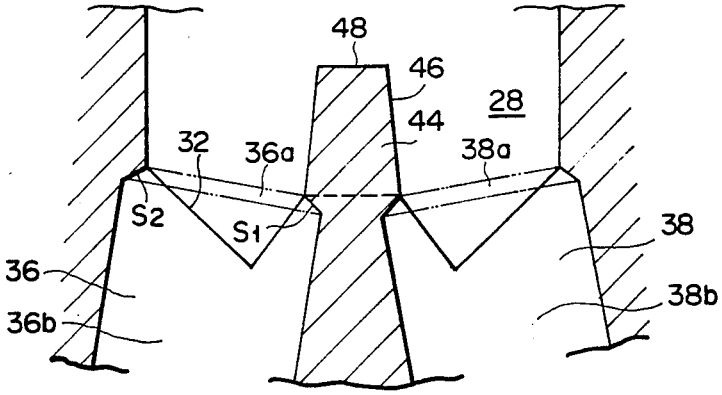
FIG. 7 is an enlarged, cross sectional view of the pillar and injected fuel paths included in the end portion of the fuel injection valve of FIG. 1.

As shown in FIG. 1B and FIG. 7, a step portion $S_1$ is formed just downstream of side surface 46 of pillar 44 in the first embodiment. (As will be illustrated and described hereinafter with respect to FIG. 9, such a step portion $S_1'$ is formed at an axially intermediate portion of side surface 46 of pillar 44 in the second embodiment.) More particularly, as shown in FIGS. 1A, 1B and 2, a diameter (b in the first embodiment) of a cross-section of a portion of pillar 44, axially adjacent to upstream end portion 36*a*, 38*a*, 40*a* of each injected fuel path 36, 38, 40, is larger than a diameter c of a circle which has a center on the longitudinal axis of adapter 6 and tangentially contacts every circular cross-section of an uppermost portion of remaining portion 36*b*, 38*b*, 40*b* of every injected fuel path 36, 38, 40 from inside of the circumferential arrangement of the three injected fuel paths 36, 38 and 40 around the axis of adapter 6, so that the step portion $S_1$ under-cut toward the axis of adapter 6 is formed between side surface 46 of pillar 44 and remaining portion 36*b*, 38*b*, 40*b* of each injected fuel path 36, 38, 40 by one portion of the downwardly facing wall surface of upstream end portion 36*a*, 38*a*, 40*a* of each injected fuel path 36, 38, 40. In the first embodiment, step portion $S_1$ is connected to a radially inner periphery of bottom surface 32 of concave portion 7.

Similarly, as shown in FIG. 1, another step portion $S_2$ is formed just downstream of side surface 30 of concave portion 7. More particularly, as shown in FIGS. 1A, 1B and 2, a diameter B of a circle which has its center on the longitudinal axis of adapter 6 and contacts every cross-section of an uppermost portion of remaining portion 36*b*, 38*b*, 40*b* of every injected fuel path 36, 38, 40 from outside of the circumferential arrangement of the three injected fuel paths 36, 38 and 40 around the axis of adapter 6 is larger than a diameter C of side surface 30 of concave portion 7, so that the step portion $S_2$ undercut in a direction away from the axis of adapter 6 is formed between each remaining portion 36*b*, 38*b*, 40*b* of each injected fuel path 36, 38, 40 and side surface 30 of concave portion 7 by one portion of the downwardly facing wall surface of upstream end portion 36*a*, 38*a*, 40*a* of each injected fuel path 36, 38, 40.

As shown in FIG. 1, pillar 44 and each injected fuel path 36, 38, 40 have the following structural relationship:

$$l \geqq A/\sin(\beta-\alpha)$$

where, l is a length of a straight line which extends in a plane including the axis of adapter 6 and extends from a radially outermost end of top surface 48 of pillar 44 to a circle (a circle with a diameter D shown in FIG. 3 and a flow of fuel is controlled to be directed toward the circle by appropriately determining a ratio of the diameter of top surface 48 of pillar 44 to the diameter of pillar-like pattern of injected fuel 50) having its center on the axis of adapter 6 and contacting a downstream side opening of every injected fuel path 36, 38, 40 from outside of the circumferential arrangement of injected fuel paths 36, 38 and 40 around the axis of adapter 6;

$\beta$ is an angle, smaller than 90°, defined between the above-defined straight line and the axis of adapter 6;

$\alpha$ is an angle, smaller than 90°, defined between an axis of each injected fuel path 36, 38, 40 and the axis of adapter 6; and A is a diameter of remaining portion **36*b*, 38*b*, 40*b* of each injected fuel path 36, 38, 40, measured in a direction perpendicular to the axis of each injected fuel path 36, 38, 40**.

The above-defined relationship is required to direct the flow of fuel, when it flows from the position of top surface 48 of pillar 44 in the downstream direction, toward (a) a radially outermost portion, corresponding to the circle with diameter D, of a most downstream portion of each injected fuel path 36, 38, 40 or (b) a portion of an inside surface of each injected fuel path 36, 38, 40 slightly above the radially outermost portion, so that the flow of fuel is prevented from flaring more than the angle $\beta$ and a stable fuel injection from each injected fuel path 36, 38, 40 can be obtained.

As shown in FIG. 1, a space remains between top surface 48 of pillar 44 and fuel injection hole 24. Preferably, the space, pillar 44 and fuel injection hole 24 satisfy the following structural relationship:

$$\pi \cdot a \cdot l_1 \geqq \cdot d^2/4$$

where, a is a diameter of top surface 48 of pillar 44;

$l_1$ is an axial distance between top surface 48 of pillar 44 and fuel injection hole 24; and d is a diameter of fuel injection hole 24.

The above-defined relationship is required to maintain a sufficient space between fuel injection hole 24 and top surface 48 of pillar 44, so that a stable pressure of fuel is obtained in injector body 4. If the space between fuel injection hole 24 and top surface 48 of pillar 44 was smaller than the space determined by the above-defined relationship, a back pressure of fuel in injector body 4 would be increased and badly affected by the collision of the fuel with top surface 48 of pillar 44.

As shown in FIG. 1, in the first embodiment, bottom surface 32 of concave portion 7 includes a first portion **32*a* which obliquely extends downwardly and radially inwardly from a lowermost portion of side surface 30 of concave portion 7 and a second portion 32*b* which obliquely extends downwardly and radially outwardly from a lowermost portion of side surface 46 of pillar 44 and joins first portion 32*a* of bottom surface 32 at a radially innermost portion of first portion 32*a*. The joining portion 32*c* of first and second portions 32*a* and 32*b* extends in the circumferential direction of adapter 6 and defines a most downstream portion of bottom surface 32 of concave portion 7**.

Next, the second embodiment shown in FIGS. 9 and 10 will be explained only as to the structures different from those of the first embodiment. Explanation of portions of the second embodiment having the same structures as those of the first embodiment will be omitted by denoting the portions with the same reference numerals as those of the first embodiment.

In the second embodiment, as shown in FIG. 9, bottom surface 32 of concave portion 7 comprises a single surface **32*d* which obliquely extends downwardly and radially inwardly from the lowermost portion of side surface 30 of concave portion 7 to side surface 46 of pillar 44. Each injected fuel path 36, 38, 40 interferes in space with dead volume portion 28 at an upstream portion of each injected fuel path 36, 38, 40 as shown by the cross hatched portion 104 in FIG. 10. As a result, a step portion $S_1'$ is formed in pillar 44 axially above bottom surface 32 of concave portion 7 and is spaced from bottom surface 32 of concave portion 7. Such step portions $S_1'$ are formed three in number when injected fuel paths 36, 38 and 40** are provided three in number.

Next, operation of fuel injection valve 2 will be explained. Because the operation of the second embodiment is the same as that of the first embodiment, only operation of the first embodiment will be explained.

Figure 6:
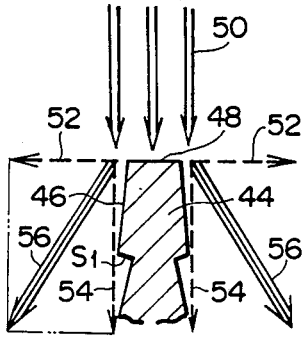
FIG. 6 is a schematic diagram illustrating the fuel flows in vector format in the vicinity of a top surface of a pillar included in the end portion of the fuel injection valve of FIG. 1.

As shown in FIG. 5, the fuel which has been metered by fuel injection hole 24 and injected through fuel injection hole 24 into dead volume portion 28 forms pillar-like pattern of injected fuel 50 at dead volume portion 28 and flows toward top surface 48 of pillar 44. Because pillar-like pattern of injected fuel 50 has a larger diameter than top surface 48 of pillar 44, the fuel of the radially inner portion of pillar-like pattern of injected fuel 50 collides with top surface 48 of pillar 44, while the fuel of the radially outer portion of pillar-like pattern of injected fuel 50 does not collide with top surface 48 of pillar 44. As shown in FIG. 6, when the fuel of the radially inner portion of pillar-like pattern of injected fuel 50 collides with top surface 48 of pillar 44, it changes its flow direction from a direction along the axis of adapter 6 to a radially outward direction. The vector 52 of the radially outwardly flowing fuel flow and the vector 54 of the axially flowing fuel flow of the radially outer portion of pillar-like pattern of injected fuel 50 are synthesized as vectors to form a resultant vector 56 of the joined fuel. The joined fuel mainly flows obliquely with respect to the axis of adapter 6, that is, flows axially downwardly and radially outwardly. Due to the oblique flow, the joined fuel is prevented from flowing toward and attaching to side surface 30 of concave portion 7 and from flowing along and attaching to side surface 46 of pillar 44. Attachment of fuel onto top surface 48 of pillar 44 is negligible because the area of top surface 48 is small and top surface 48 is washed by strong flow of the fuel. Thus, a nearly entire portion of the injected fuel can flow directly into injected fuel paths 36, 38 and 40 without attaching to and collecting on surfaces of various portions of adapter 6. Thus, amount of the fuel injected through injected fuel paths 36, 38 and 40 is stable without being affected by the fuel which has been injected through fuel injection hole 24 at a prior injection and has attached to and collected on the surfaces of the concave portion or the injected fuel paths of the adapter. Because a conventional fuel injection valve does not have pillar 44 of the present invention, a considerably large portion of the injected fuel will attach to and collect on the surfaces of the concave portion and the injected fuel paths in such a conventional fuel injection valve.

Pillar 44 of fuel injection valve 2 according to the present invention further functions to atomize or break the injected fuel to pieces. More particularly, as shown in FIG. 5, the main flow of the injected fuel forms a hollow cone pattern of injected fuel after collision with top surface 48 of pillar 44. Thickness of a cone-like membrane of the injected fuel is gradually decreased in the downstream direction in accordance with an increase in diameter of the cone-like membrane of the injected fuel and is finally atomized or broken to pieces. Thus, when the fuel is injected from injected fuel paths 36, 38 and 40 into the intake path of the engine, the fuel is sufficiently atomized to thereby improve the combustion characteristic and response characteristic of the engine.

When top surface 48 of pillar 44 is circular, the fuel flow shown by vector 52 in FIG. 6 can be formed uniformly in the circumferential direction of pillar 52. When the cross-section of pillar 44 is circular over the entire length of pillar 44, machining top surface 48 of pillar 44 to a circular shape will be easily performed and uniform distribution of the fuel around the axis of pillar 44 will be easily obtained. When top surface 48 of pillar 44 is flat, the fuel flow shown by vector 52 in FIG. 6 can be directed in the direction perpendicular to the longitudinal axis of pillar 44. This helps to accurately and easily direct the joined fuel flow shown by vector 56 in FIG. 6 to the aimed direction.

Though a small portion of the injected fuel may flow along side surface 46 of pillar 44, such a small flow is directed so as to flow into injected fuel paths 36, 38 and 40, because side surface 46 of pillar 44 is tapered so as to spread the joined fuel flow in the downstream direction. When step portion $S_1$ ($S_1'$ in the second embodiment) is formed at a connecting portion of side surface 46 of pillar 44 and each injected fuel path 36, 38 and 40, the fuel flow along side surface 46 of pillar 44 is easily separated from side surface 46 of pillar 44 at step portion $S_1$ ($S_1'$ in the second embodiment) and is prevented from attaching to and collecting on the inside surface of each injected fuel path 36, 38, 40. Step portion $S_1$ ($S_1'$ in the second embodiment) also functions to generate a turbulence in the fuel flow near the step portion to thereby help the fuel atomize when the fuel is separated from side surface 46 of pillar 44.

Similarly, though a small portion of the injected fuel may flow toward and attach to side surface 30 of concave portion 7, such a fuel is easily separated from side surface 30 of concave portion 7 at step portion $S_2$ and is prevented from attaching to and collecting on the inside surface of each injected fuel path 36, 38, 40. Step portion $S_2$ also functions to form a turbulence in the fuel flow near step portion $S_2$ to thereby help the fuel be atomized when the fuel is separated from side surface 30 of concave portion 7.

When the structural relationship of $1 = A / \sin(\beta - \alpha)$ holds, the joined fuel flow having vector 56 shown in FIG. 6 and flowing toward the circle having diameter D shown in FIG. 3 contacts the radially outermost end of the lowermost portion of each injected fuel path 36, 38, and 40. Due to this structural relationship, the fuel flow is regulated from spreading more than angle $\beta$ and a stable pattern of fuel injection from injected fuel paths 36, 38 and 40 is obtained. When the relationship of $1 = A / \sin(\beta - \alpha)$ holds, the joined fuel flow scarcely attaches to the inside surface of injected fuel paths 36, 38 and 40 and, therefore, this case is most preferable. The dimension 1 may be larger than $A / \sin(\beta - \alpha)$, though in such a case the hollow cone-like pattern of the joined fuel is directed to portions, of the inside surfaces of injected fuel paths 36, 38 and 40, upwardly distanced from the lowermost portions of injected fuel paths 36, 38 and 40. Because attachment of the fuel to the inside surfaces of injected fuel paths 36, 38 and 40 should be suppressed, the dimension 1 is preferred to be nearly equal to $A / \sin(\beta - \alpha)$. The dimension 1 should not be smaller than $A / \sin(\beta - \alpha)$, because if the dimension 1 is smaller than $A / \sin(\beta - \alpha)$, the joined fuel flow having vector 56 does not contact the radially outermost end portion of the lowermost portion of each injected fuel path 36, 38, 40 and, as a result, the hollow cone-like pattern of the joined fuel can not be regulated by the lower end portions of injected fuel paths 36, 38 and 40 and will easily fluctuate due to manufacturing tolerances of adapter 6.

To obtain stable fuel injection, a sufficient space should exist between top surface 48 of pillar 44 and fuel injection hole 24. When the space is too small, a back pressure Pf (shown in FIG. 5) of fuel inside injector body 4 will be affected by the collision of the fuel with top surface 48 of pillar 44 and will change. More particularly, the amount of the fuel injected through fuel injection hole 24 is determined by the cross-sectional area of fuel injection hole 24 and the pressure difference between the pressure Pf inside injector body 4 and the pressure Pi at dead volume portion 28. The pressure Pi of dead volume portion 28 is substantially equal to the pressure in the intake port of the engine, because dead volume portion 28 is constantly connected to the intake port through injected fuel paths 36, 38 and 40. When the back pressure Pf inside injector body 4 changes because of too small space between fuel injection hole 24 and pillar 44, the amount of the fuel injected through fuel injection hole 24 changes and stable fuel injection can not be obtained. In the present invention, because a space larger than the space determined by the relationship of $\pi a\, l_1 \geqq \pi d_2 / 4$ holds between fuel injection hole 24 and top surface 48 of pillar 44, the back pressure Pf inside injector body 4 will not be badly affected by top surface 48 of pillar 44 and is maintained to a desired or targeted pressure. As a result, stable fuel injection can be obtained.

Because bottom surface 32 of concave portion 7 includes a surface inclined toward the downstream direction, that is, first surface **32*a*, 32*b* in the first embodiment and surface 32*d* in the second embodiment, the small amount of fuel which has attached to bottom surface 32 can easily flow along bottom surface 32 toward the lowermost portion of bottom surface 32 and can finally flow into injected fuel paths 36, 38 and 40. Thus, the fuel does not tend to collect on bottom surface 32 of concave portion 7**.

Summarily, the following effects can be obtained according to the present invention.

Because pillar 44 which is spaced from and faces fuel injection hole 24 is provided, the fuel which has been injected through fuel injection hole 24 and flows toward pillar 44 collides with top surface 48 of pillar 44 to form a hollow cone-like pattern of injected fuel and a large portion of the fuel can directly flow into and pass through injected fuel paths 36, 38 and 40. As a result, the fuel is prevented from attaching to and collecting on bottom surface 32 and side surface 30 of concave portion 7 and the inside surfaces of injected fuel paths 36, 38 and 40. Therefore, the amount of the fuel injected from injected fuel paths 36, 38 and 40 is stable without being affected by the fuel which has been injected through fuel injection hole 24 at a prior fuel injection and has collected on the surfaces of concave portion 7 and injected fuel paths 36, 38 and 40.

Further, due to the collision of the fuel with top surface 48 of pillar 44 and due to the hollow cone-like pattern of the fuel formed after the collision with top surface 48 of pillar 44, fuel is effectively atomized to improve the combustion characteristic and response characteristic of the engine.

Although only a few preferred embodiments of the present invention have been described in detail, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

what is claimed is:

1. A fuel injection valve for mounting on an internal combustion engine, comprising:

an injector body having an end surface and a single fuel injection hole for metering fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion formed in the adapter so as to have an axis common with the axis of the adapter, a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and a pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein each of the injected fuel paths includes an upstream end portion and a remaining portion connected to the upstream end portion, the upstream end portion being reduced in diameter in the upstream direction, the remaining portion having a constant cross-sectional area over an entire length of the remaining portion; and wherein a diameter of a cross-section of a portion of the pillar, axially adjacent to the upstream end portions of the injected fuel paths, is larger than a diameter of a circle which has a center on the axis of the adapter and tangentially contacts an uppermost portion of the remaining portion of every injected fuel path from inside of a circumferential arrangement of the fuel injected fuel paths around the axis of the adapter, so that a step portion undercut toward the axis of the adapter is formed between the side surface of the pillar and the remaining portion of every injected fuel path by a portion of a wall surface of the upstream end portion of every injected fuel path.

2. The fuel injection valve according to claim 1, wherein the step portion is connected to an inner periphery of the bottom surface of the concave portion.

3. The fuel injection valve according to claim 1, wherein the step portion is positioned above and is spaced from the bottom surface of the concave portion.

4. A fuel injection valve for mounting on an internal combustion engine, comprising:

an injector body having an end surface and a single fuel injection hole for metering fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion formed in the adapter so as to have an axis common with the axis of the adapter, a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein each of the injected fuel paths includes an upstream end portion and a remaining portion connected to the upstream end portion, the upstream end portion being reduced in diameter in the upstream direction, the remaining portion having a constant cross-sectional area over an entire length of the remaining portion; and wherein a diameter of a circle which has a center on the axis of the adapter and tangentially contacts a cross-section of an uppermost portion of the remaining portion of every injected fuel path from outside of a circumferential arrangement of the injected fuel paths around the axis of the adapter is larger than a diameter of the side surface of the concave portion so that a step portion undercut in a direction away from the axis of the adapter is formed between the remaining portion of every injected fuel path and the side surface of the concave portion by a portion of the upstream end portion of every injected fuel path.

5. A fuel injection valve for mounting on an internal combustion engine, comprising:

an injector body having an end surface and a single fuel injection hole for mounting fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion formed in the adapter so as to have an axis common with the axis of the adapter, a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and a pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein the pillar and each of the injected fuel paths have the following structural relationships:

$$1 = A / \sin(\beta - \alpha)$$

where, 1 is a length of a straight line which extends in a plane including the axis of the adapter and extends from a radially outermost end of the top surface of the pillar to a circle having its center on the axis of the adapter and tangentially contacting a cross-section of a lowermost portion of each of the injected fuel paths from outside of a circumferential arrangement of the injected fuel paths around the axis of the adapter;

$\beta$ is an angle, smaller than 90<, defined between the above-defined straight line and the axis of the adapter;

$\alpha$ is an angle, smaller than 90<, defined between an axis of each of the injected fuel paths and the axis of the adapter; and A is a diameter of a portion with a constant cross-sectional view of each of the injected fuel paths, measured in a direction perpendicular to the axis of each injected fuel path.

6. A fuel injection valve for mounting on an internal combustion engine, comprising:

an injector body having an end surface and a single fuel injection hole for metering fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion formed in the adapter so as to have an axis common with the axis of the adapter, a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and a pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein a space remains between the top surface of the pillar and the fuel injection hole the space, the pillar and the fuel injection hole satisfying the following structural relationship:

$$\pi \cdot a \cdot 1_1 = \pi \cdot d_2 / 4$$

where, a is a diameter of the top surface of the pillar;

$1_1$ is a difference between the top surface of the pillar and the fuel injection hole; and d is a diameter of the fuel injection hole.

7. A fuel injection valve for mounting on an internal combustion engine, comprising;

an injector body having an end surface and a single fuel injection hole for metering fuel to be injected, the fuel injection hole having n axis common with a longitudinal axis of the injector body an opening at the end surface of the injector body; and an adapter fixed to the injector body and having an axis common with the longitudinal axis of the injector body, the adapter including:

a recessed concave portion formed in the adapter so as to have an axis in common with the axis of the adapter, a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of the injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and a pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein the bottom surface of the concave portion includes a first portion which obliquely extends downwardly and radially inwardly .rom a lowermost portion of the side surface of the concave portion and a second portion which obliquely extends downwardly and radially outwardly from a lowermost portion of the side surface of the pillar and joins the first portion at a radially innermost portion of the first portions extending in a circumferential direction of the adapter and defining a most downstream portion of the bottom surface of the concave portion.

8. A fuel injection valve for mounting on an internal combustion engine, comprising:

an injector body having an end surface and a single fuel injection hole for metering fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion formed in the adapter so as to have an axis common with the axis of the adapter, a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and a pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein the bottom surface of the concave portion comprises a single surface which obliquely extends downwardly and radially inwardly from a lowermost portion of the side surface of the concave portion to the side surface of the pillar.

9. A fuel injection valve for mounting on an internal combustion engine, comprising:

an injector body having an end surface and a single fuel injection hole for metering fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion formed in the adapter so as to have an axis common with the axis of the adapter, a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and a pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein an area, measured in a direction perpendicular to the longitudinal axis of the pillar, of the top surface of the pillar is smaller than a cross-sectional area, measured in a direction perpendicular to the axis of the fuel injection hole formed in the injector body, of the fuel injection hole; and wherein the top surface of the pillar is substantially flat.

10. The fuel injection valve according to claim 9. wherein the top surface of the pillar is circular in a direction perpendicular to the longitudinal axis of the pillar.

11. The fuel injection valve according to claim 9, wherein the pillar has a substantially circular cross-section in a direction perpendicular to the longitudinal axis of the pillar over an entire length of the pillar.

12. The fuel injection valve according to claim 9, wherein the side surface of the pillar is tapered in the downstream direction such that an upstream portion of the pillar is smaller in diameter than a downstream portion of the pillar.

13. The fuel injection valve according to claim 9, wherein three fuel injected paths are provided.

14. A fuel injection valve for mounting on an internal combustion engine, comprising:

an injector body having an end surface and a single fuel injection hole for metering fuel to be injected, the fuel injection hole having an axis common with a longitudinal axis of the injector body and opening at the end surface of the injector body; and an adapter fixed to the injector body and having an axis common with the longitudinal axis of the injector body, the adapter including:

a recessed concave portion formed in the adapter so as to have an axis common with the axis of the adapter a side surface and a bottom surface, the side and bottom surfaces of the concave portion of the adapter and the end surface of the injector body defining therebetween a dead volume portion located in a direction downstream of and communicating with the fuel injection hole formed in the injector body;

a plurality of injected fuel paths formed in the adapter and communicating with the dead volume portion, the injected fuel paths being arranged around the axis of the adapter so as to be equally spaced from each other, the injected fuel paths extending through the adapter in an axial direction of the adapter and being inclined radially outward in the downstream direction with respect to the axis of the adapter so as to be further spaced from the axis of the adapter in a direction perpendicular to the axis of the adapter at downstream portions of the injected fuel paths than at upstream portions of the injected fuel paths, all the injected fuel paths opening to the dead volume portion from a downstream side of the dead volume portion; and a pillar extending from the bottom surface of the concave portion toward the fuel injection hole formed in the injector body to extend into the dead volume portion, the pillar having a longitudinal axis common with the axis of the adapter, a side surface and a top surface which is spaced from and opposite to the fuel injection hole formed in the injector body;

wherein an area, measured in a direction perpendicular to the longitudinal axis of the pillar, of the top surface of the pillar is smaller than a cross-sectional area, measured in a direction perpendicular to the axis of the fuel injection hole formed in the injector body, of a pillar-like pattern of injected fuel which is formed in the dead volume portion by fuel injected from the fuel injection hole; and wherein the top surface of the pillar is substantially flat.

* * * * *